US005765498A

United States Patent [19]

Hammarstedt

[11] Patent Number: 5,765,498

[45] Date of Patent: Jun. 16, 1998

[54] BOWSPRIT ARRANGEMENT

[76] Inventor: Gösta Leopold Hammarstedt, Smålandsgatan 11, Nybro 382 31, Sweden

[21] Appl. No.: 828,906

[22] Filed: Apr. 2, 1997

Related U.S. Application Data

[63] Continuation of PCT/SE97/00208, Feb. 12, 1997.

[30] Foreign Application Priority Data

May 3, 1996 [SE] Sweden ..... 9601692

[51] Int. Cl.[6] ..... B63B 15/00

[52] U.S. Cl. ..... 114/97; 114/39.001

[58] Field of Search ..... 114/39.1, 89, 97, 114/102, 103

[56] References Cited

U.S. PATENT DOCUMENTS 830,720 9/1906 Jensen .

3,141,435 7/1964 Moffitt, Jr. ..... 114/39.1

4,354,447 10/1982 Hultgren ..... 114/255

5,301,623 4/1994 McMillen ..... 114/61

FOREIGN PATENT DOCUMENTS

WO 87/02322 4/1987 WIPO .

*Primary Examiner*—Ed L. Swinehart

*Attorney, Agent, or Firm*—Luedeka, Neely & Graham, P.C.

[57] ABSTRACT

A bowsprit is attached to a boat by fixing members. The bowsprit comprises two bowsprit rods which are hingedly interconnected by a hinge at the free end of the bowsprit. At a distance from this end, the rods are pivotable relative to the boat and slidably connected to the fixing members for permitting displacement of the bowsprit between a stowed-away position and a position of use.

10 Claims, 4 Drawing Sheets

BOWSPRIT ARRANGEMENT

This is a continuation of International Application No. PCT/SE97/00208, filed Feb. 12, 1997, (pending).

FIELD OF THE INVENTION

The suit of sails on sailing-boats without bowsprit is limited to mainsail, genoa, mizzen and spinnaker. Sailing-boats having a bowsprit afford greater possibilities of selecting the type of sail. One type of headsail, which is common nowadays, is a so-called genaker, which is larger than a usual mizzen and therefore would extend, like a common genoa, behind the mast, if a bowsprit would not be used. A bowsprit results in an increase of the total length of the boat and may also be disadvantageous when making the boat fast to a bridge or pier. Thus there is a need of an easily dismountable bowsprit.

SUMMARY OF THE INVENTION

One object of the present invention is to satisfy this need. A further object is to provide a dismountable bowsprit, which can easily be stowed away on deck. One more object is to provide a dismountable bowsprit, the mounting and dismounting of which can take place without any risk that the bowsprit is lost by falling into the sea.

According to the invention, these and other objects are achieved if the bowsprit is designed as defined in claim 1. The dependent claims define particularly preferred embodiments of the invention.

In the invention, a bowsprit thus is fixed to a boat by means of fixing members. The bowsprit has two bowsprit rods, which are hingedly connected to each other at the free end of the bowsprit. At a distance from this end, the rods are pivotable relative to the boat and slidably connected to the fixing members for permitting displacement of the bowsprit between a stowed-away position and a position of use.

BRIEF DESCRIPTION OF THE DRAWING

The invention will now be described in more detail with reference to the accompanying drawings, which illustrate three embodiments of a bowsprit arrangement according to the invention and in which

The embodiment of an inventive bowsprit arrangement as shown in FIGS. 1–6 comprises a bowsprit 10 having two bowsprit rods 11, 12. They are interconnected at the free end of the bowsprit by means of a hinge 13. In the embodiment shown, the rods 11, 12 are made as square tubes of, for instance, stainless steel or anodized light metal. The hinge 13 has two hinge halves 14, 15 with mounting pins 16 for insertion into the end of the respective rods 11, 12. In the shown embodiment, use is made of two through bolts 17 which are passed through holes in the bowsprit rods 11, 12 and in the mounting pins 16, thereby ensuring safe assembly of the hinge 13 and each rod 11 and 12. The through hinge pin 18 of the hinge is in two pieces which can be screwed together to permit mounting. Each piece of the hinge pin has a fixing lug 19. The upper of the fixing lugs serves as attachment for the sail 20, for instance a genaker, which is to be secured to the bowsprit. The lower of the fixing lugs serves as attachment for a stay cable 21, whose other end is fixed to a stay attachment 22 a distance downwards along the stem of the boat. The forces to which the bowsprit is subjected are, in fact, essentially directed upwards. FIG. 1 also shows a mast stay cable 64, which is attached to the stem of the boat and to the top of the mast.

Figure 1:
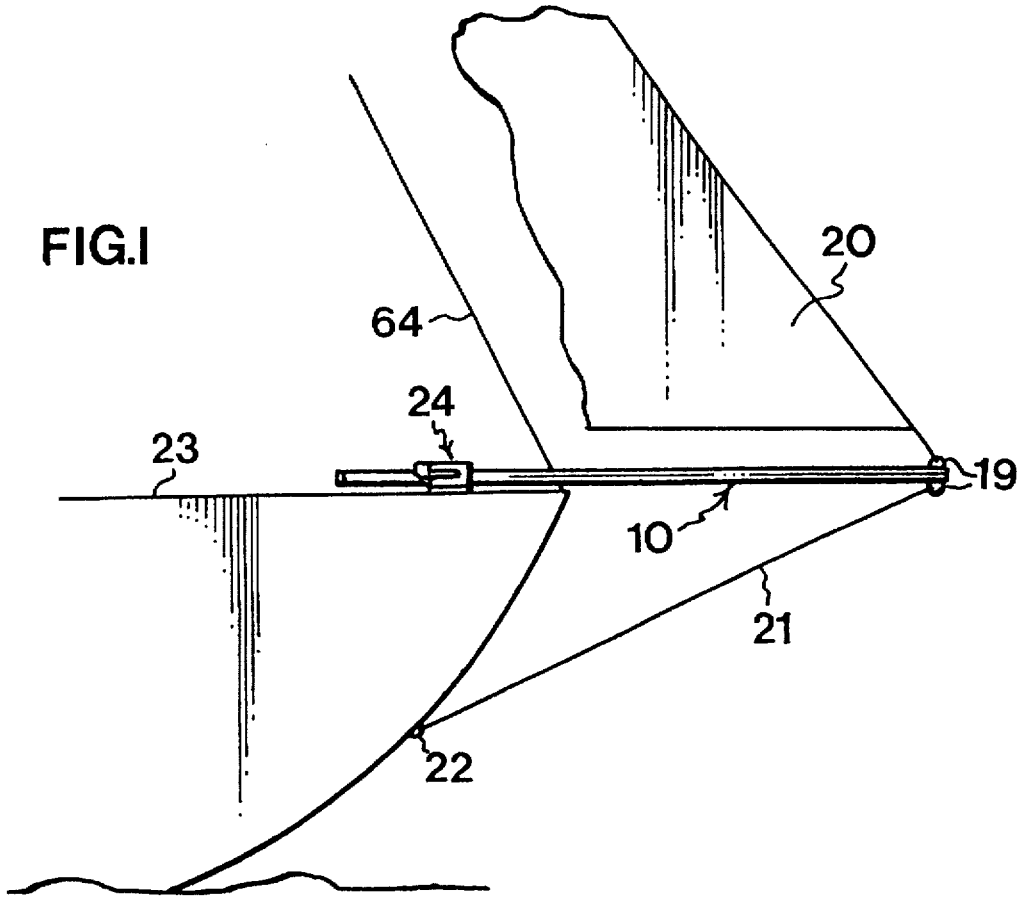
FIG. 1 illustrates the stem of a sailing-boat with an example of a bowsprit according to the invention.

The bowsprit 10 is secured to the deck 23 of the boat by two bowsprit attachments 24. They allow pivoting of the bowsprit rods 11, 12 about an axis essentially parallel to the hinge pin 18. Moreover, they are designed in such manner that the rods 11, 12 can be displaced longitudinally relative to the bowsprit attachments. In the embodiment shown in FIGS. 1–6, this has been made possible by each bowsprit attachment 24 being formed with a guide sleeve 25, which by means of a pivot pin connection 26 is turnably connected to a mount 27. The mount is attached to the deck of the boat by means of through screws 28 and is sealed against the deck of the boat in some suitable manner.

The pivot pin connection 26 can be designed in various ways. The drawings illustrate a preferred design. In this case, a pivot pin 43 is attached by welding to the guide sleeve 25 or is, in some other manner, non-rotatably connected thereto. The pivot pin comprises two flanges 44 projecting at a distance from one another and, inserted therebetween, an O-ring seal. The lower of the flanges has its underside on the same level as the end of a sleeve 45, in which the pivot pin is inserted. The sleeve 45 is welded to the mount 27. The end of the pivot pin 43 protrudes from the sleeve 45 and is threaded. A locking nut 46 is screwed to the threaded end of the pivot pin and is tightened against the lower flange 44. Besides, the nut is locked in some suitable manner relative to the thread, such that the nut will be in sliding engagement with the end surface of the sleeve 45, when the guide sleeve 25 pivots.

With a view to securing the bowsprit rods 11, 12 in their outer positions while the bowsprit 10 is used, they have a locking means 29 at a suitable distance from the rear free end of the rods. In the Example, there are locking means 29 on both sides of the rods by a through square pin being mounted in each rod. The locking means engage the end surface of the guide sleeve 25, when the bowsprit is in its position of use. The locking means and, thus, the bowsprit rods 11, 12 are kept in this position by means of an essentially U-shaped latch 30, which is pivotally mounted on the guide sleeve 25 by means of pivot pins 31. The two locking hooks of the latch have an inclined guiding surface 33 so as to automatically raise the latch when the bowsprit rods approach their front position and the locking means 29 reach the guide sleeves 35. If desired, the latches can be spring-loaded in the direction of their position shown in FIG.

3, i.e. counterclockwise in respect of this Figure. When the locking hooks 32 of the latch engage the locking means 29, the cross member 34 of the latch rests against the upper side of the bowsprit rod 11 and 12, respectively.

In the embodiment illustrated in FIGS. 1–6, each guide sleeve 25 is provided with a cleat 35 on its upper side, but of course this is not necessary for the invention.

Figure 2:
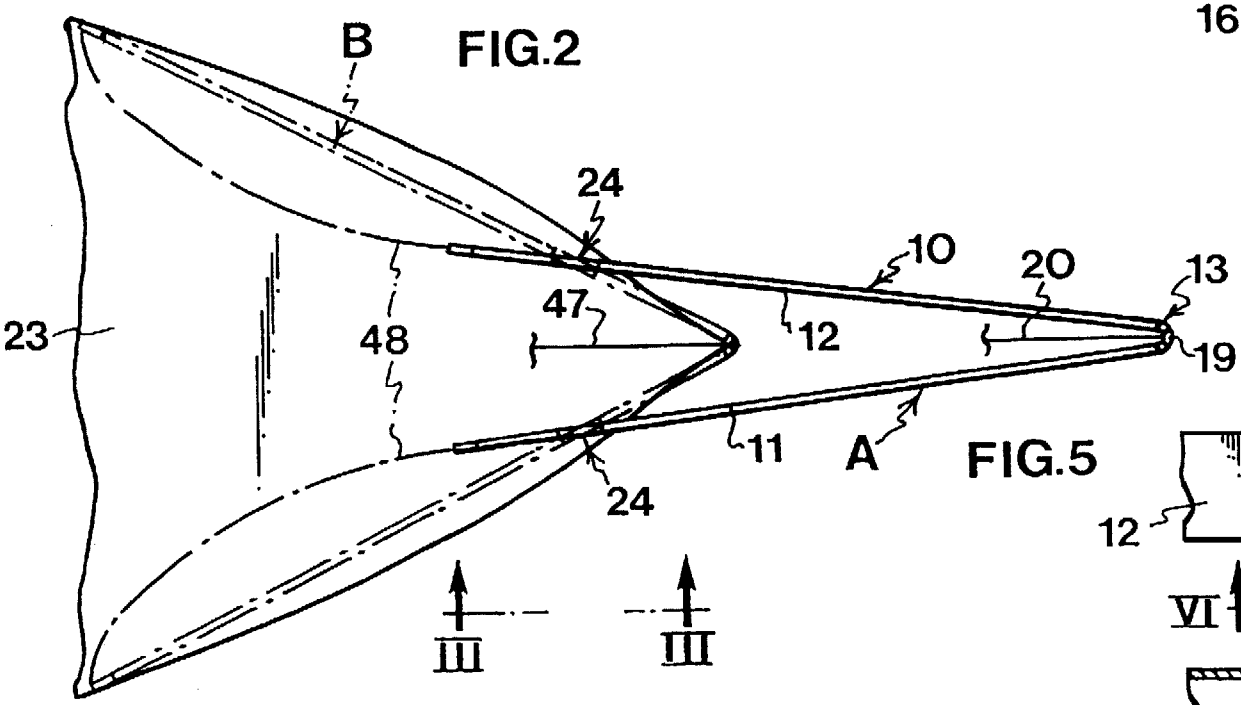
FIG. 2 is a top plan view of the same portion of the boat.
Figure 3:
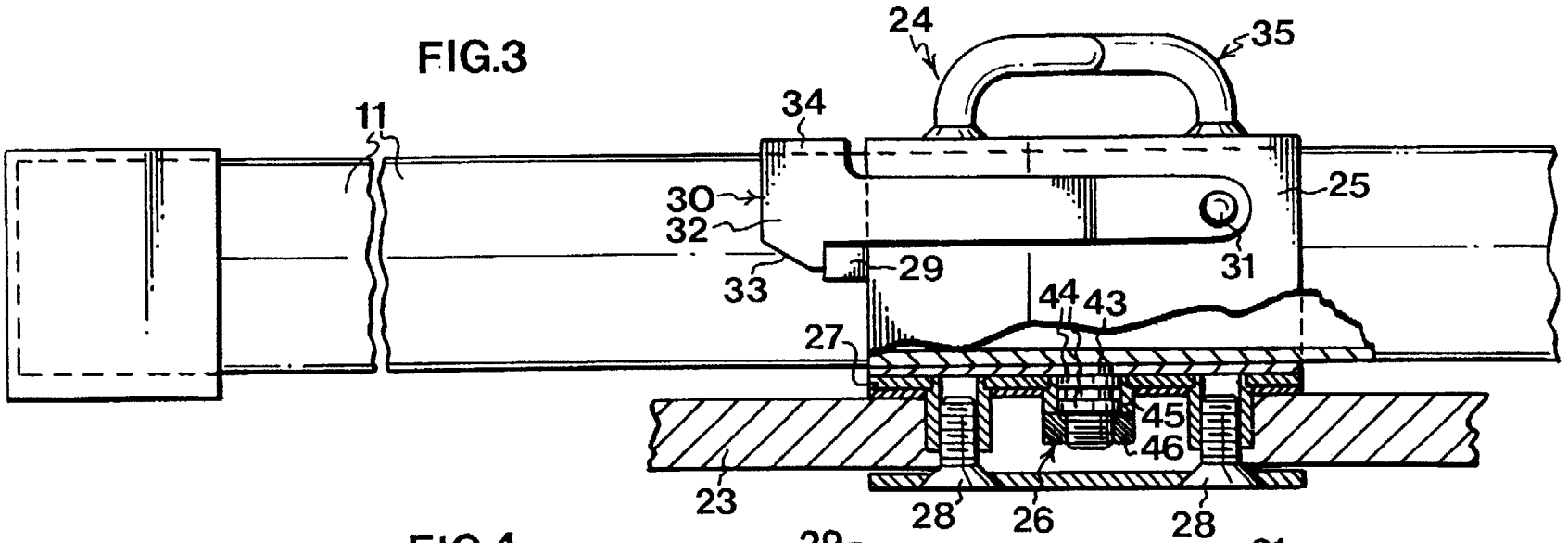
FIG. 3 is a partly sectional view of parts of the bowsprit arrangement along line III—III in FIG. 2.
Figure 4:
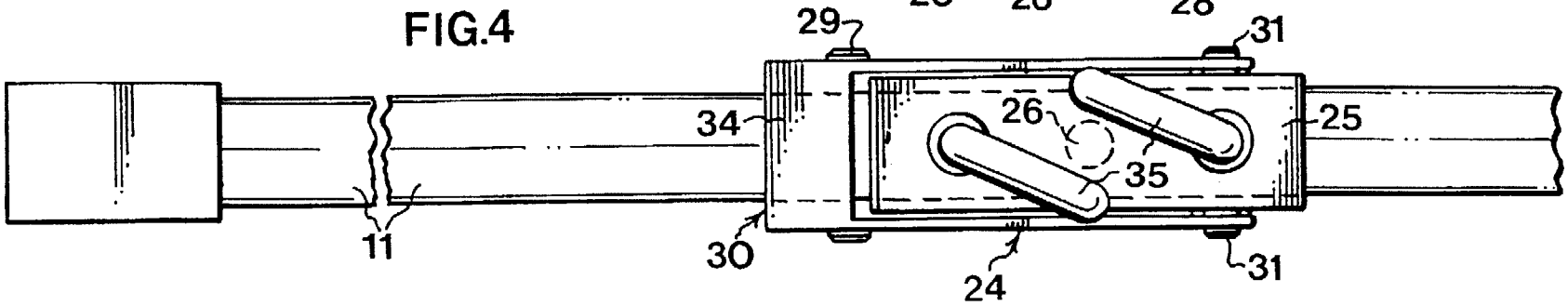
FIG. 4 is a top plan view of the same parts.

By the bowsprit 10 being in two pieces and hinged at its outer end as well as displaceable and turnable relative to its two bowsprit attachments 24, the bowsprit can be pulled in from its position of use A and stored in a stowed-away position B along the bulwark of the boat, as indicated by dash-dot lines in FIG. 2. In this position, it can be secured in some suitable manner, for instance by the stay cable 21, after being loosed from the stay attachment 22, being tied to one of the two cleats or some other suitable mounting or cleat on the boat.

When the bowsprit is to be used, the lower end of the sail 20 is attached to the upper fixing lug 19 on the hinge 13, whereupon the bowsprit is pushed out to its outer position, in which the inclined guiding surfaces 23 of the locking means 29 raise the latch 30 such that the locking means can come into engagement with the end surface of the guide sleeves 25. Thus, the end surface forms an abutment surface for the locking means. When the latch has been lowered by hand or under the action of gravity or by spring force, the bowsprit is locked in its outer position. The next step is to tighten the stay cable 21 after it has been passed through its stay attachment 22. Finally, the sail 20 is hoisted.

When the sail and the bowsprit are no longer to be used, these operations are carried out in the opposite order.

Figure 7:
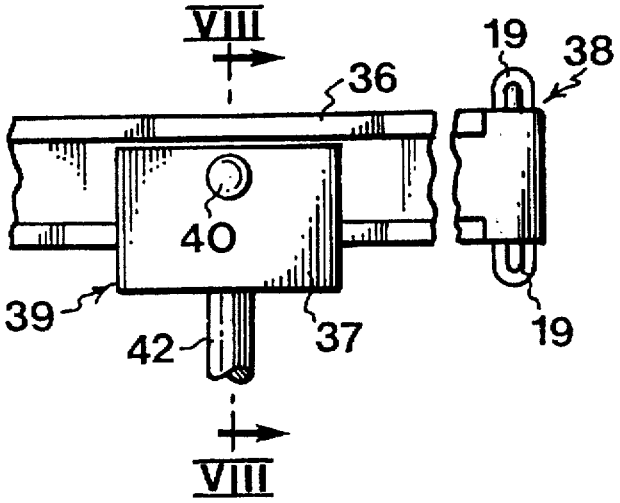
FIG. 7 is a view corresponding to FIG. 3, of a different embodiment of an inventive bowsprit arrangement.
Figure 8:
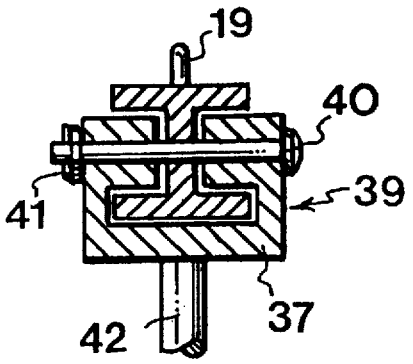
FIG. 8 is a cross-sectional view along line VIII—VIII in FIG. 7.
Figure 6:
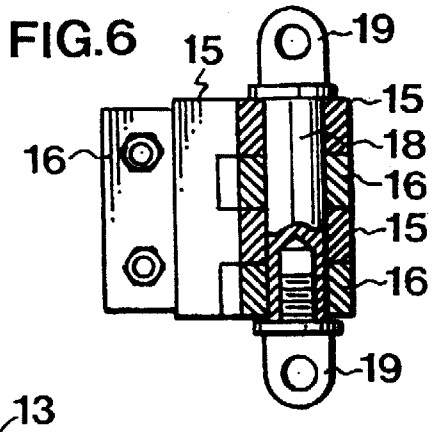
FIG. 6 illustrates but the hinge portion of a section along line VI—VI in FIG. 5.
Figure 5:
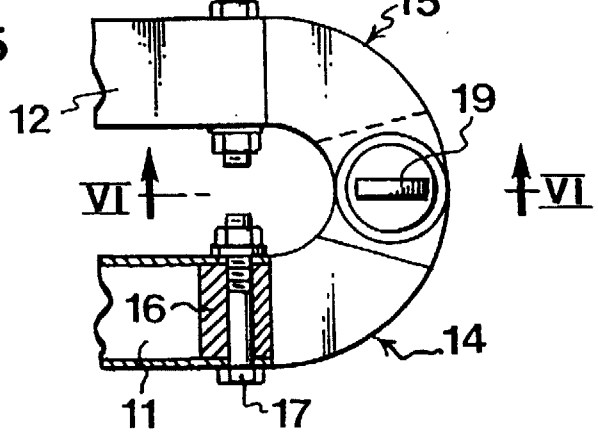
FIG. 5 is partly a top plan view, partly a cross-sectional view of a portion of the free end of the bowsprit.

In FIGS. 1–6, bowsprit rods in the form of square tubes are used. Other types of rods, however, can also be used. A usable form of rod is a rod in the shape of an I-beam, as illustrated in the embodiment in FIGS. 7 and 8. In this case, the bowsprit rods 36 are also pivotally interconnected by means of a schematically illustrated hinge 38 at the free outer end of the bowsprit. The bowsprit attachments 39 are in this case formed as U-beam pieces 37 having inwardly directed mouth flanges to form an undercut groove, through which the I-beam-shaped bowsprit rods can be moved back and forth. As locking device for locking the bowsprit in the pulled-out position, use is in this case simply made of a through locking pin 40, which has been passed through holes in the bowsprit attachment and in the web of the I-beam. For securing of the locking pin, use is made of e.g. a locking peg 41. By means of a pivot pin 42, the bowsprit attachment is combined with a mount (not shown) of about the same type as the mount 27 in the embodiment according to FIGS. 1–6.

Figure 9:
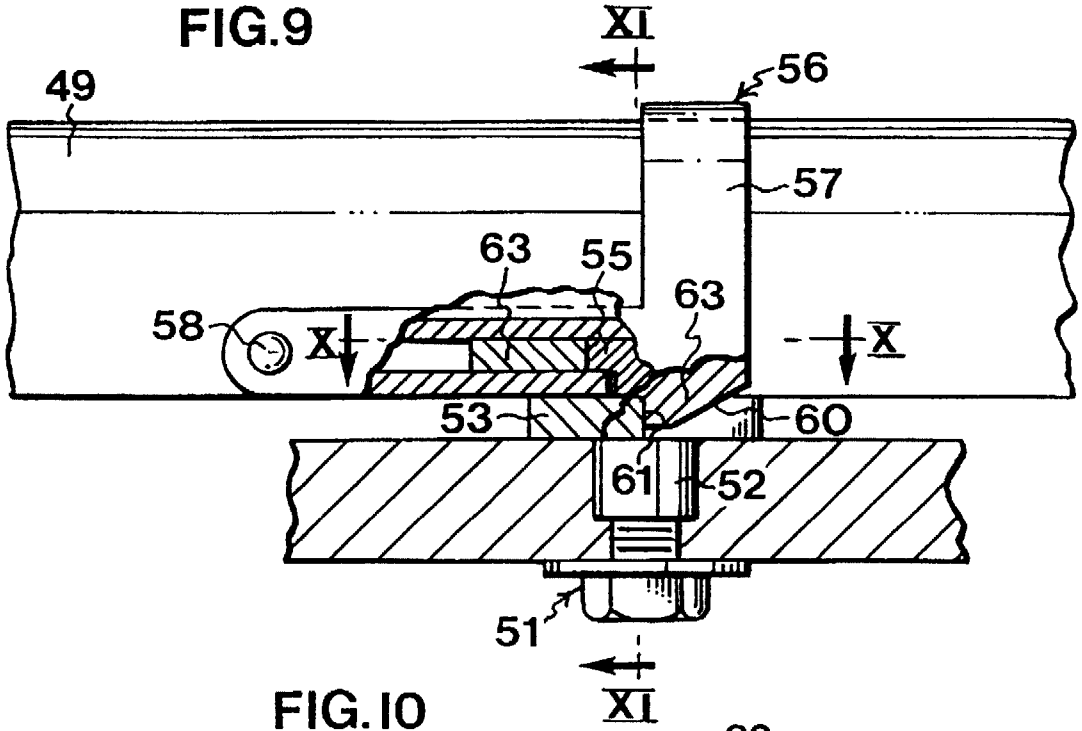
FIG. 9 is a view corresponding to FIG. 3, in cross-section of a third embodiment of an inventive bowsprit arrangement.
Figure 10:
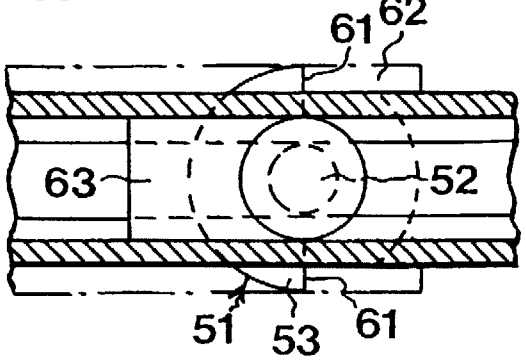
FIG. 10 is a sectional view along line X—X in FIGS. 9 and 11, a latch included in the arrangement being indicated only by dash-dot lines for reasons of clarity.
Figure 11:
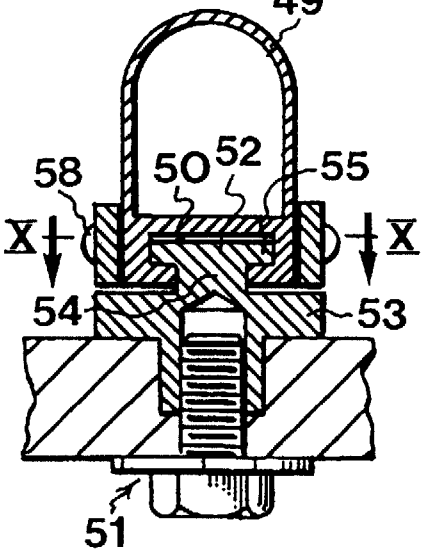
FIG. 11 is a sectional view along line XI—XI in FIG. 9.

The embodiment of the invention as illustrated in FIGS. 9–11 comprises bowsprit rods 49, which in their underside have a longitudinal undercut groove 50. For reasons of clarity, only one bowsprit rod is shown. The two rods 49 are pivotally interconnected by means of a hinge, which is not shown in these Figures but is designed in about the same way as the hinge in the embodiment according to FIGS. 1–6.

A bowsprit attachment 51 is screwed to the deck 23 of the boat. The attachment comprises a pin 52 projecting upwards from the deck. The pin has an outwardly directed flange 53, which abuts against the deck of the boat. Moreover, it has a collar portion 54 inwardly of an outwardly directed flange 55 arranged at the outer end. The flange is inserted in the undercut groove 50 of the bowsprit rod 49, and the collar portion 54 of the pin fits into the slot-shaped mouth of the undercut groove in such a manner that the bowsprit rod can both slide in the longitudinal direction relative to the bowsprit attachment and be turned about this about an axis which is essentially parallel to the pivot axis in the hinge between the two bowsprit rods. This embodiment of the invention thus confers the advantage that fewer components are required to permit both longitudinal displacement and pivoting of the bowsprit rods relative to their point of attachment on the boat.

Also in this embodiment of the invention, there is a locking device 56 for locking the bowsprit rods relative to their fixing members (the pin 52), when the bowsprit is in its pulled-out position of use. The locking device has a latch 57, which resembles the latch in the embodiment according to FIGS. 1–6, but which instead is attached to the bowsprit rods 49 in a pivotable manner by means of pivot pins 58. Also in this case, the locking hooks 59 of the latch have inclined guiding surfaces 60 for automatically moving the latch aside by engagement with the outwardly directed flange 52 of the bowsprit attachment 51, when the bowsprit rod approaches its end position when pulling out the bowsprit.

The locking hooks 59 cooperate with abutment surfaces 61 of the flange 52. The abutment surfaces are formed by a recess 62, formed as half a circular segment, being made on opposite sides of the flange 52, the recesses permitting the locking hooks to reach the abutment surfaces 61.

The locking members also comprise a locking means 63 inserted in the undercut groove 50 and forming an abutment surface, which is fixed relative to the bowsprit rod, and being fixed in such a position relative to the latch 57 that a continued displacement of the bowsprit rod 49 is stopped by the locking means 63 when the locking hooks 59 of the latch have come into engagement with the abutment surfaces 61 of the pin 52. Otherwise, the locking device and the bowsprit function in the same manner as described in connection with the embodiment according to FIGS. 1–6.

The drawings illustrate three different embodiments of the bowsprit rods and the associated bowsprit attachments. Within the scope of the invention, other embodiments can also be used as long as the bowsprit rods can be displaced longitudinally relative to the bowsprit attachments and, adjacent to the bowsprit attachments, be turned relative to the boat to permit pulling out and pulling in of the bowsprit between the position of use and the stowed-away position.

As is apparent from that stated above, the invention provides a new bowsprit which is easy to use and which can easily be pulled out to the position of use and just as easily be pulled back to the stowed-away position, and which requires but little space (the areas outside the dash-dot lines 48 in FIG. 2) on the foredeck for displacement between its two outer positions A and B.

What I claim and desire to secure by Letters Patent is:

1. A bowsprit arrangement, comprising a bowsprit and fixing members for fixing the bowsprit to a boat, wherein the bowsprit has two bowsprit rods, which are hingedly connected to each other at the free end of the bowsprit and which are, at a distance from said end, slidably connected to the fixing members and, adjacent to the fixing members, pivotable relative to the boat for permitting displacement of the bowsprit between a stowed-away position and a position of use.

2. The bowsprit arrangement of claim 1, wherein the fixing members are pivotable relative to the boat.

3. The bowsprit arrangement of claim 1, wherein the bowsprit rods are interconnected by means of a hinge which has an attachment for a sail.

4. The bowsprit arrangement of claim 2, wherein the bowsprit rods are interconnected by means of a hinge which has an attachment for a sail.

5. The bowsprit arrangement as claimed in claim 4, wherein the hinge also has an attachment for a stay cable.

6. The bowsprit arrangement of claim 1, wherein the fixing members comprise slide means which are designed for sliding engagement with the bowsprit rods and for preventing the bowsprit rods from moving transversely of the slide means.

7. The bowsprit arrangement of claim 6, wherein the fixing members comprise a mount which is secured to the boat and to which the slide means are pivotally connected.

8. The bowsprit arrangement of claim 1, comprising a locking device for locking the bowsprit rods relative to the fixing members in the position of use of the bowsprit.

9. The bowsprit arrangement of claim 8, wherein the locking device comprises a pivotable latch arranged on the fixing members and adapted to cooperate with at least one locking means on the associated bowsprit rod and securing this locking means to an abutment surface formed on the fixing members.

10. The bowsprit arrangement of claim 8, wherein the locking device comprises a latch arranged on the bowsprit rod and adapted to cooperate with at least one locking means on the associated fixing member and securing this locking means to an abutment surface formed on the bowsprit rod.

* * * * *

UNITED STATES PATENT AND TRADEMARK OFFICE

CERTIFICATE OF CORRECTION

PATENT NO : 5,765,498
DATED : June 16, 1998
INVENTOR(S) : Gosta Leopold Hammerstedt It is certified that error appears in the above-identified patent and that said Letters Patent is hereby corrected as shown below:

Column 1, line 14, change "would not be" to -- is not --.

Column 1, line 16, change "making" to -- fastening -.

Column 1, line 16, delete "fast".

Column 1, line 54, delete "but".

Column 2, line 48, change "Besides, the nut" to
-- The nut 46 --.

UNITED STATES PATENT AND TRADEMARK OFFICE

CERTIFICATE OF CORRECTION

PATENT NO : 5,765,498
DATED : June 16, 1998
INVENTOR(S) : Gosta Leopold Hammerstedt It is certified that error appears in the above-identified patent and that said Letters Patent is hereby corrected as shown below:

Column 2, line 49, change "thread," to -- threads --; and after "nut" insert -- 46 --.

Column 2, line 63, after "hooks" insert -- 32 --.

Column 2, line 66, change "35" to -- 25 -.

Column 2, line 66, after "latches" insert -- 30 --.

Column 3, line 9, change "outer" to -- free --.

Column 3, line 21, change "23 of" to -- 33 of the latch 30 engage --.

UNITED STATES PATENT AND TRADEMARK OFFICE

CERTIFICATE OF CORRECTION

PATENT NO : 5,765,498
DATED : June 16, 1998
INVENTOR(S) : Gosta Leopold Hammerstedt It is certified that error appears in the above-identified patent and that said Letters Patent is hereby corrected as shown below:

Column 3, line 22, change "raise" to -- raising --.

Column 3, line 25, after "means" insert -- 29 -- and after "latch" insert -- 30 --.

Column 4, line 1, delete "this about"

Column 4, line 17, change "52" to -- 53 --.

Column 4, line 21, change "52" to -- 53 --.

Column 4, line 23, change "52 of" to -- 53 --.

Column 4, line 24, after "hooks" insert -- 59 --

Column 4, line 25, change "63" to -- 64 --.

Column 4, line 30,change "63" to -- 64 --.

Column 4, line 32, change "pin 52" to -- flange 53 --.

Signed and Sealed this

Tenth Day of November 1998

Bruce Lehman

*Attest:*

BRUCE LEHMAN

*Attesting Officer*

*Commissioner of Patents and Trademarks*